US006491755B1

(12) United States Patent
Meinke

(10) Patent No.: US 6,491,755 B1
(45) Date of Patent: Dec. 10, 2002

(54) PAINTING APPARATUS WITH COMPOUND RACK

(75) Inventor: Joseph S. Meinke, Gowen, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 94 days.

(21) Appl. No.: 09/658,908

(22) Filed: Sep. 11, 2000

(51) Int. Cl.[7] ..... B05C 13/02; B05C 5/02

(52) U.S. Cl. ..... 118/320; 118/321; 118/323; 118/500

(58) Field of Search ..... 118/320, 321, 118/323, 500; 427/421, 425

(56) References Cited

U.S. PATENT DOCUMENTS

| | | | | |
|---|---|---|---|---|
| 1,227,617 A | | 5/1917 | Hodgson | |
| 2,343,375 A | | 2/1944 | Shurley | |
| 2,426,391 A | | 8/1947 | Emerson | |
| 2,808,343 A | | 10/1957 | Simmons | |
| 3,989,001 A | | 11/1976 | Brigham et al. | |
| 4,082,870 A | | 4/1978 | Yenni | |
| 4,616,593 A | * | 10/1986 | Kawamura et al. | 118/303 |
| RE33,766 E | | 12/1991 | Duffy et al. | |
| 5,145,526 A | * | 9/1992 | Oldham | 118/319 |
| 5,403,624 A | | 4/1995 | DiMaio et al. | |
| 5,624,496 A | * | 4/1997 | Scharf et al. | 118/314 |
| 5,881,668 A | | 3/1999 | Begin et al. | |
| 5,989,644 A | | 11/1999 | Williams | |
| 6,004,627 A | | 12/1999 | Duffy et al. | |

* cited by examiner

*Primary Examiner*—Laura Edwards
(74) *Attorney, Agent, or Firm*—Young & Basile, P.C.

(57) ABSTRACT

A painting apparatus including a rack assembly mounted on a carriage and adapted to be moved on the carriage between a load station, a paint application station, and an unload station. The rack assembly includes a main rack assembly mounted for rotation about a central axis and a plurality of rack subassemblies carried by the main rack assembly and mounted for respective rotation about a plurality of subassembly axes spaced circumferentially about and parallel to the central axis. As the main rack assembly undergoes rotation about the central axis at the paint application station, the rack subassemblies simultaneously rotate about their subassembly axes so that the parts carried by the subassemblies undergo a compound rotation with the result that even intricate interior surfaces on the parts are given a uniform coating of paint.

20 Claims, 4 Drawing Sheets

FIG - 1
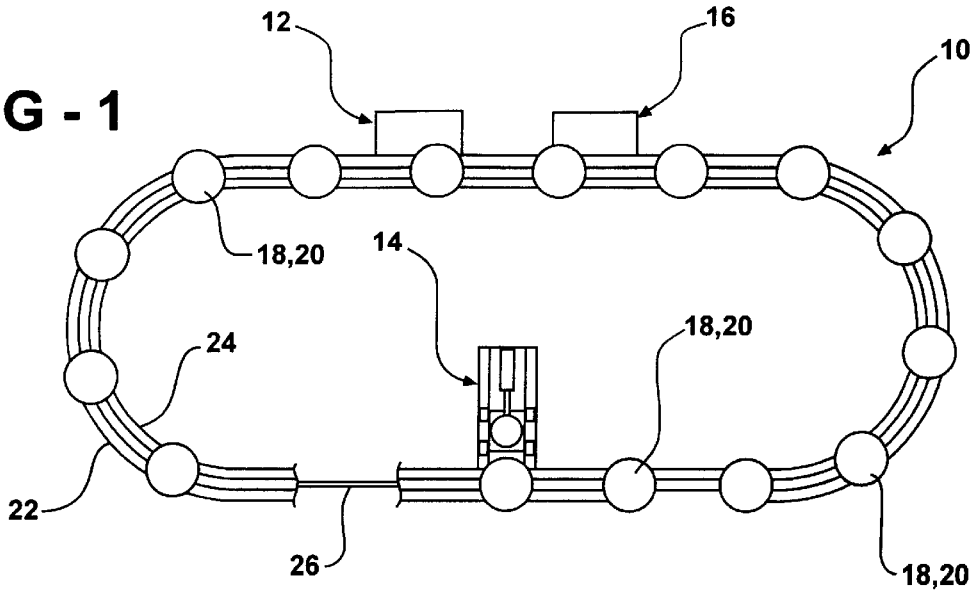
FIG - 5
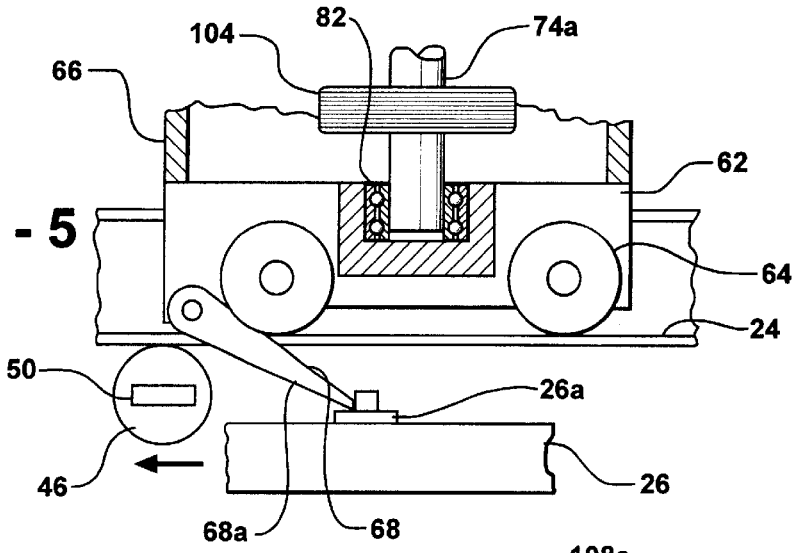
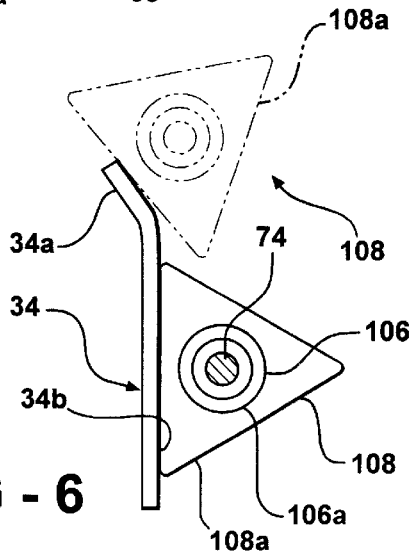
FIG - 6

PAINTING APPARATUS WITH COMPOUND RACK

BACKGROUND OF THE INVENTION

This invention relates to apparatus for coating parts and more particularly to apparatus for spray painting parts.

Most parts in modern industrial equipment require some manner of coating or painting to optimize the appearance of the part and/or to protect the part. Many techniques are available for painting parts. Whereas the many available techniques are generally satisfactory for painting parts having only exterior surfaces to be painted or having interior surfaces that are simple and readily accessible, none in of the prior art painting techniques provide smooth, even, consistent coating with respect to all surfaces on an intricate part including intricate blind interior surfaces.

SUMMARY OF THE INVENTION

This invention is directed to the provision of an improved painting apparatus.

More specifically, this invention is directed to the provision of an improved painting apparatus whereby a smooth, even coating may be consistently and uniformly applied even to intricate interior surfaces.

The painting apparatus of the invention comprises a main rack assembly mounted for rotation about a central axis; a plurality of rack subassemblies carried by the main rack assembly and mounted for respective rotation about a plurality of subassembly axes spaced circumferentially about and parallel to the central axis; a plurality of part holder devices provided on each rack subassembly at spaced locations along the respective subassembly axis; and drive means operate to spin the main rack about the central axis while simultaneously spinning each of the rack subassemblies about their respective subassembly axes. This compound rotation of the parts to be painted, about both the central axis of the main rack assembly and simultaneously about the axis of the respective rack subassembly, has been found to be effective to apply smooth uniform, even coating even to a part having an intricate interior surface configuration.

According to a further feature of the invention, the main rack assembly comprises a central vertical shaft mounted for rotation about the central axis, an upper support structure proximate an upper end of the shaft, and a lower support structure proximate a lower end of the shaft; and each rack subassembly includes a vertical part support structure journaled at an upper end thereof in the upper support structure, journaled at a lower end thereof in the lower support structure, and mounting the part holder devices intermediate the upper and lower ends thereof. This specific rack construction facilitates the provision of the compound rotation of the part.

According to a further feature of the invention, the drive means includes primary drive means operate to spin the vertical shaft about the central axis and secondary drive means operative to spin the vertical part support structures about the subassembly axes, and the secondary drive means are driven by the primary drive means via the spinning of the vertical shaft. This specific drive arrangement simplifies the drive of the rack assembly and rack subassemblies.

According to a further feature of the invention, the secondary drive means includes a sun gear journaled on the central shaft, a lock device operate to preclude rotation of the sun gear about the central axis irrespective of rotation of the central shaft, and a planet gear mounted on each subassembly axis, drivingly engaging the respective vertical part support structure, and meshing with the sun gear. This specific secondary drive arrangement provides a simple and effective means of converting the rotation of the main rack assembly into rotation of the secondary rack assemblies.

According to a further feature of the invention, the painting apparatus further includes a carriage movable along a path to a paint application station and means at the paint application station to halt the carriage at the station; the main rack is mounted on the carriage for rotation about the central axis; and the drive means includes a power device at the paint application station operative to engage and rotate the main rack about the central axis and thereby rotate the rack subassemblies about their respective subassembly axes. This arrangement facilitates movement of the rack assembly along a paint apparatus path and further facilitates compound rotation of the rack assembly as the rack assembly arrives at the paint application station.

According to a further feature of the invention, the main rack comprises a central shaft mounted for rotation about the central axis; the power device includes a driving wheel; and the drive means further includes a driven wheel fixedly mounted on the central shaft and engageable with the driving wheel. This arrangement, in combination with the previously described secondary drive means, allows the power device located at the paint application station to readily drive both the main rack assembly as well as the secondary rack assemblies whereby to achieve compound rotation of the parts to be painted and thereby achieve effective painting of the parts.

According to a further feature of the invention, the painting apparatus further includes a track structure defining the path extending to the paint application station; a load station and an unload station positioned at spaced locations along the path; a paint spray apparatus positioned at the paint application station; means for moving the carriage along the path between the load station, the paint application station, and the unload station; means for halting the carriage at the paint application station; and means for initiating the operation of the paint spray apparatus in response to halting of the carriage at the paint application station. With this arrangement, the power device positioned at the paint application station is operative with the carriage halted at the paint application station, and simultaneous with the operation of the paint spray apparatus, to spin the main rack about the central axis while simultaneously spinning each of the rack subassemblies about their respective subassembly axes.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a diagrammatic view of a painting apparatus according to the invention;

FIGS. 5 and 6 are fragmentary detail views illustrating operational aspects of the painting apparatus.

DESCRIPTION OF THE PREFERRED EMBODIMENT

Figure 2:
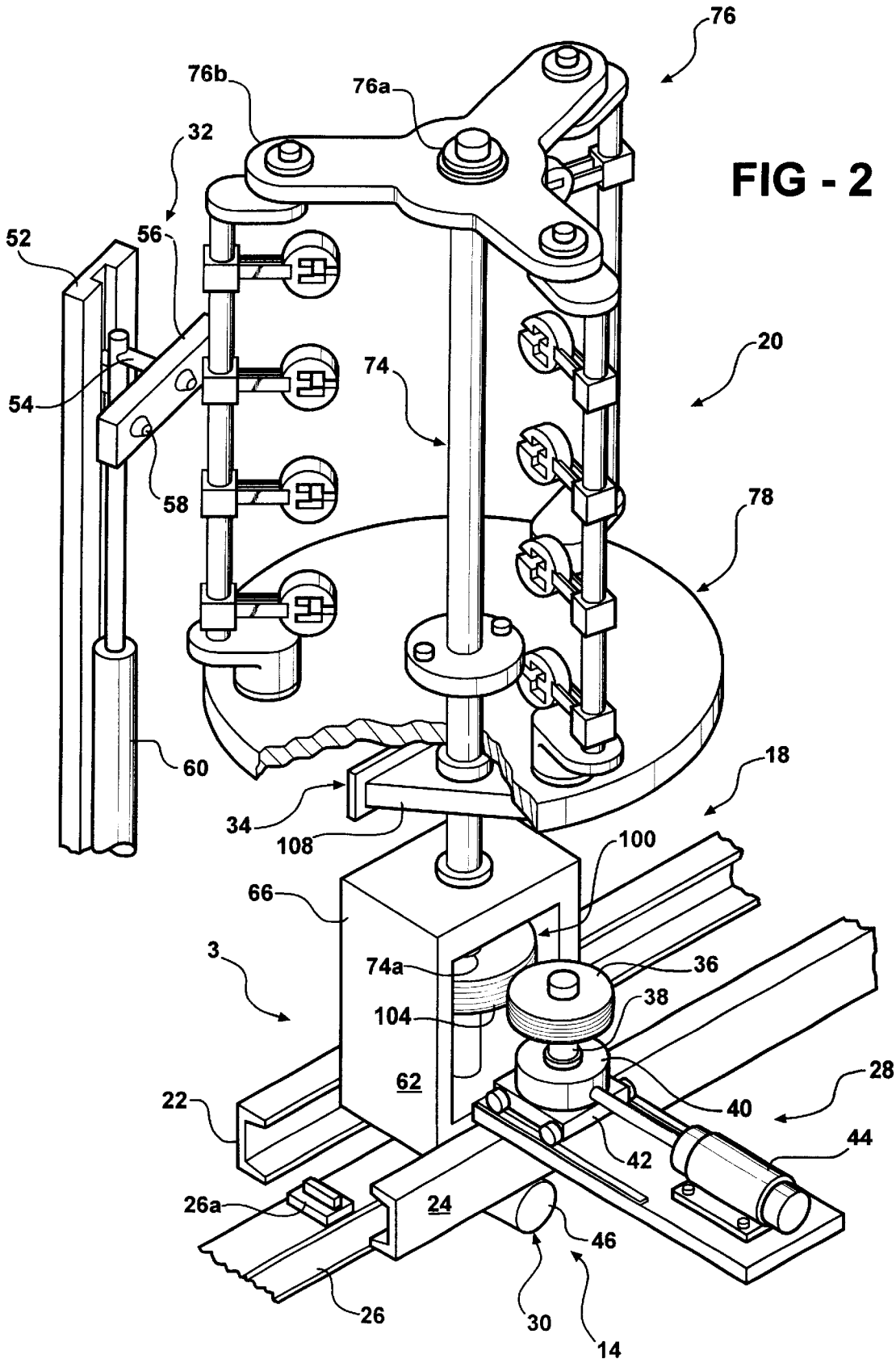
FIG. 2 is a fragmentary perspective view of a carriage and rack assembly positioned at a paint application station of the painting apparatus.

The painting apparatus of the invention, broadly considered, includes (FIG. 1) a track assembly 10, a load station 12, a paint application station 14, an unload station 16, a plurality of carriages 18, and a plurality of rack assemblies 20 each associated with a respective carriage.

Track assembly 10 is of known configuration and may include, as shown, a loop structure defined by a pair of opposed channel members 22 and 24 with a power chain conveyor 26 extending around the closed loop beneath the channel members. Conveyor 26 is continuously powered and operates, in a power and free manner, to impart selective movement to carriages moving around the track assembly. Load station 12 is of known form and comprises a location along the path defined by the track assembly at which parts P to be painted are loaded onto a rack assembly 20 for movement to the paint application station 14 and subsequent movement to the unload station 16 where the painted parts are removed whereafter the unloaded carriage and rack assembly may move to the load station to receive new parts P for painting.

Figure 3:
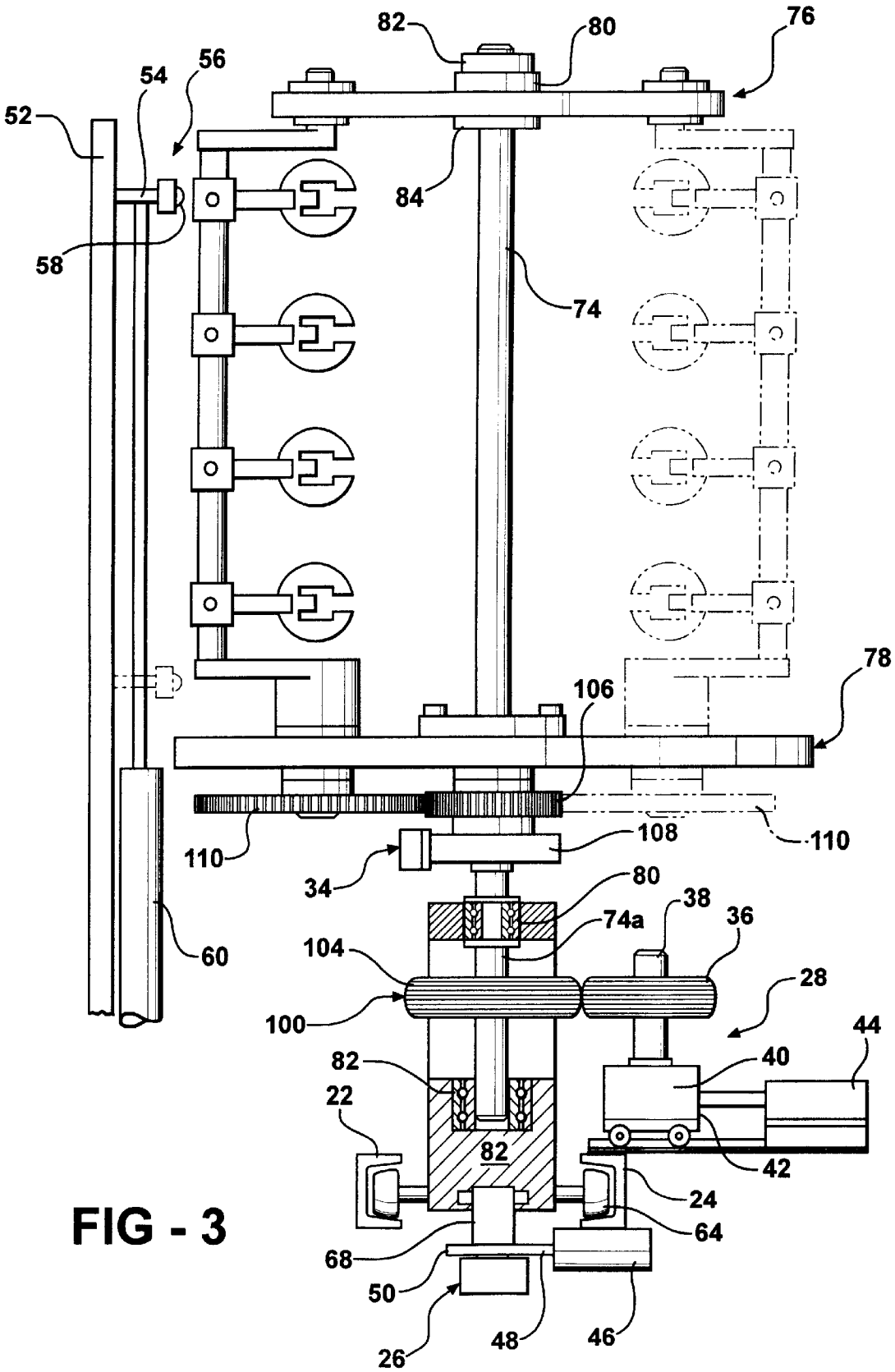
FIG. 3 is a view looking in the direction of the arrow 3 in FIG. 2.
Figure 4:
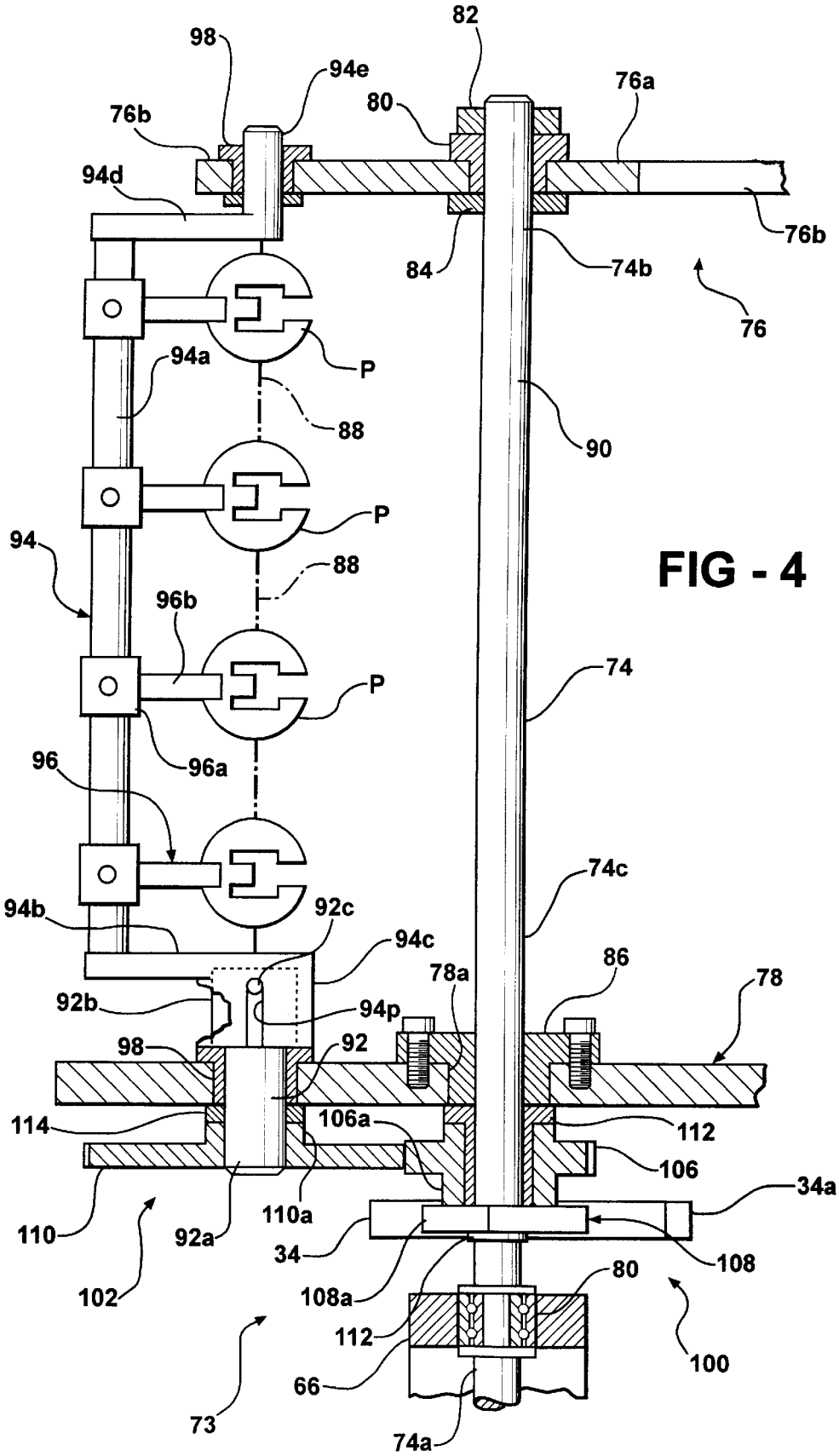
FIG. 4 is a fragmentary detail view of the rack assembly.

Paint application station 14 includes (FIGS. 2, 3, and 4) a power device 28, a cam mechanism 30, a spray gun assembly 32, and a cam locking track 34.

Power device 28 is schematically and representationally shown and includes a driving wheel 36 driven by a shaft 38 powered by an electric motor 40 mounted on a carriage 42 mounted for reciprocal to and fro movement by a power cylinder 44.

Cam mechanism 30 includes a solenoid 46 controlling a plunger 48 carrying a cam member 50. Solenoid 46 mounts plunger 48 and cam member 50 for reciprocal movement in a path extending over the power conveyor 26.

Spray gun assembly 32 includes a post 52, a bracket structure 54 mounted on post 52 for reciprocal vertical movement with respect to the post; a spray gun assembly 56 carried by bracket structure 54 and including a plurality of spaced spray guns 58; and an actuating mechanism (such as the schematically illustrated hydraulic cylinder 60) for moving the bracket structure 54 and thereby the spray gun assembly 56 in an up and down reciprocal fashion with respect to post 52.

Each carriage 18 includes a main body structure 62; a plurality of wheels 64 mounted on the main body structure and rollably received in channel members 22 and 24 whereby to mount the carriage for rollable movement along the path defined by the channel members 22 and 24; a gantry structure 66 upstanding from main body 62; and a dog 68 (see also FIG. 5) pivotally mounted on the lower face of the main body 62 of the carriage for power and free coaction at its lower end 68*a* with a lug 26*a* carried by power conveyor 26.

Rack assembly 20 includes a main rack assembly 70, a plurality of rack subassemblies 72, and a drive means 73.

Main rack assembly 70 comprises a central vertical shaft 74, an upper support structure 76, and a lower support structure 78.

Shaft 74 is journaled at its lower end 74*a* in carriage 18 and may specifically, for example, be journaled by bearing means 80 in the upper crossbar of gantry structure 66 and at its extreme lower end in the main body 62 of the carriage by bearing means 82.

Upper support structure 76 has a triangulated or spoked configuration and includes a central hub portion 76*a* and a plurality of circumferentially spaced spoke portions 76*b* extending radially outwardly from the central hub portion. The upper end 74*b* of shaft 74 is keyed to upper support structure 76 by a hub 80 fixedly secured to hub 76*a* and keyed to the upper end of the shaft and by upper and lower collars 82 and 84 whereby rotation of shaft 74 rotates upper support structure 76.

Lower support structure 78 has a disc configuration and is keyed to shaft 74 by a hub 86 fixedly secured in a central aperture 78*a* of the lower support structure. Hub 86 centrally passes shaft 74 and is keyed to the shaft so that rotation of the shaft rotates lower support structure 78.

Rack subassemblies 72 are positioned in circumferentially spaced relation about shaft 74 and are mounted for respective rotation about a plurality of subassembly axes 88 spaced circumferentially about and parallel to the central axis 90 of shaft 74.

Each rack subassembly 72 includes a lower pivot member 92, a part support bar 94, and a plurality of part engaging devices 96.

Lower pivot member 92 is journaled in a bushing 98 centered on axis 88 and includes a lower pin portion 92*a* journaled in the bushing and an upper head portion 92*b* carrying a transverse pin 92*c*.

Part support bar 94 includes a main body vertical bar portion 94*a*, a lower crank arm portion 94*b* terminating in a socket end 94*c*, an upper crank arm portion 94*d*, and an upper pivot portion 94*e*. Pivot portion 94*e* is journaled in a bushing 98 mounted in a suitable aperture in a spoke 76*b* on axis 88 and the socket end 94*c* of crank arm 94*b* is positioned over the head 92*b* of lower pivot member 92 with pin 92*c* received in slots 94*f* defined in the socket head 94*c*.

The structure and configuration of the part engaging devices 96 will of course depend upon the size and configuration of the parts P being painted. As schematically shown, each part engaging device 96 includes a collar portion 96*a* adjustably mounted on bar 94*a* and a clip portion 96*b* releasably engaging the part P.

Drive means 73 includes primary drive means 100 and secondary drive means 102.

Primary drive means 100 comprises a drive wheel 104 fixedly secured to the lower portion 74*a* of shaft 74 and vertically positioned in confronting relation to the drive wheel 36 of the power device 28 positioned at the paint application station whereby to and fro movement of the carriage 42 brings the drive wheel 36 into and out of driving engagement with driven wheel 104 whereby to impart rotation to the shaft 74 and thereby to the main rack assembly and the rack subassemblies carried thereby.

Secondary drive means 102 includes a sun gear 106, a lock device 108, and a plurality of planet gears 110.

Sun gear 106 is mounted on intermediate portion 74*c* of shaft 74 by a bushing 112 positioned beneath lower support structure 78.

Lock device 108 has a triangular configuration and is fixedly secured to the lower end of the hub portion 106*a* of sun gear 106. A clip 112 on shaft 74 maintains the vertical position of sun gear 106 and lock device on the shaft.

Each planet gear 110 is keyed to the lower end of the pin portion 92*a* of the respective lower pivot member 92 with a washer 114 interposed between the hub portion 110*a* of the gear and the lower face of lower support structure 78. Each gear 110 meshingly engages at its periphery with sun gear 106.

OPERATION

A plurality of parts P are suitably loaded onto each rack subassembly at load station 12 utilizing part engaging devices 96 whereafter the dog 68 of the associated carriage 18 is suitably engaged with a lug 26*a* of power conveyor 26 to move the carriage around the path defined by the track structure. As the carriage and rack arrive at paint application station 14, solenoid 46 is actuated in a sense to extend cam 50 whereby to intercept dog 68 and move dog pivotally upwardly out of engagement with the associated lug 26*a* whereby to disengage the carriage from the continuously moving conveyor 26 and halt the carriage at the paint application station. Simultaneous with the halting of the carriage at the paint application station, cylinder 44 is actuated to move drive wheel 36 into engagement with driven wheel 104 and cylinder 60 is actuated to impart a reciprocal up and down movement to the spray gun assembly 56. As the carriage arrives at the paint application station, lock device 108 engages the lead, radiused end 34*a* of cam bar 34 which has the effect (FIG. 6) of turning the lock device, irrespective of its orientation upon engagement with the cam bar, into a position in which a side 108*a* of the triangular lock device is positioned flush against the flat surface 34*b* of the cam bar to thereby preclude rotation of the lock device and the associated sun gear 106 about central axis 90. As a result, the rotation of the shaft 74 by engagement of driving wheel 36 with pivot wheel 104 not only has the effect of spinning shaft 74 and upper and lower support structures 76 and 78 about the central axis 90 but has the further effect of walking the planet gears 110 around the sun gear 106 whereby to impart rotation to each of the rack subassemblies relative to the main rack so that the parts P carried by the rack subassemblies undergo a primary rotation about the central axis 90 and a simultaneous secondary rotation about the respective subassembly axis 88. As a result, even intricate blind interior surfaces of the parts P are given an even, consistent coating.

Electric motor 40 is reversible so that either clockwise or counterclockwise rotation may be imparted to driving wheel 36 whereby to impart clockwise or counterclockwise rotation to main rack assembly 70 and corresponding rotation to the rack subassembly 72. In either case, the rack subassemblies may be arranged, as shown, to undergo rotation in the same clockwise/counterclockwise direction as the main rack or may be suitably arranged to undergo counter rotation relative to the main rack.

The various operating parameters of the apparatus will of course vary depending upon the particulars of the parts P being painted. By way of example, the various gear ratios may be chosen such that the main rack assembly rotates about axis 90 at 180 rpm and the subassemblies rotate about subassembly axes 88 at 45 rpm.

It will be understood that the track structure and carriage structure are disclosed herein in a somewhat schematic manner. Further details of a track structure and a carriage structure suitable for use with the invention rack assembly are disclosed in U.S. Pat. No. 5,989,644 and in co-pending patent application Ser. No. 09/556,506, now U.S. Pat. No. 6,350,491 both assigned to the assignee of this application and incorporated herein by reference.

It will further be understood that a suitable control system, not shown, will be provided to control the movement of conveyor 26, the actuation of solenoid 30, the actuation of cylinder 44, the energization of motor 40, the actuation of cylinder 60, the delivery of paint to spray guns 58, and the loading and unloading of the parts P at the stations 12 and 16 respectively.

The painting apparatus of the present invention will be seen to provide a high part throughput while ensuring complete paint coverage on both exterior and interior surfaces of the parts including even intricate blind surfaces on the interior surfaces of the parts.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A coating apparatus comprising:

a main rack assembly mounted for rotation about a central axis;

a spray coating device positioned proximate the main rack assembly;

a plurality of rack subassemblies carried by the main rack assembly and mounted for respective rotation about a plurality of subassembly axes spaced circumferentially about and parallel to the central axis;

a plurality of part holder devices provided on each rack subassembly at spaced locations along the respective subassembly axis; and drive means operative to spin the main rack about the central axis while simultaneously spinning each of the rack subassemblies about their respective subassembly axes.

2. A coating apparatus according to claim 1 wherein:

the main rack assembly comprises a central vertical shaft mounted for rotation about the central axis, an upper support structure fixed to the shaft proximate an upper end of the shaft, and a lower support structure fixed to the shaft proximate a lower end of the shaft; and each rack subassembly includes a vertical part support structure journaled at an upper end thereof in the upper support structure, journaled at a lower end thereof in the lower support structure, and mounting said part holder devices intermediate the upper and lower ends thereof.

3. A coating apparatus according to claim 2 wherein the drive means includes primary drive means operative to spin the vertical shaft about the central axis and secondary drive means operative to spin the vertical part support structures about the subassembly axes.

4. A coating apparatus according to claim 3 wherein the secondary drive means are driven by the primary drive means via the spinning of the vertical shaft.

5. A coating apparatus according to claim 4 wherein the secondary drive means includes a sun gear journaled on the central shaft, a lock device operative to preclude rotation of the sun gear about the central axis irrespective of rotation of the central shaft, and a planet gear mounted on each subassembly axis, drivingly engaging the respective vertical part support structure, and meshing with the sun gear.

6. A coating apparatus according to claim 1 wherein:

the coating apparatus further includes a carriage movable along a path to a coating application station and means at the coating application station to halt a carriage at the station;

the main rack is mounted on the carriage for rotation about the central axis; and the drive means includes a power device at the coating application station operative to engage and rotate the main rack about the central axis and rotate the rack subassemblies about the respective subassembly axes.

7. A coating apparatus according to claim 6 wherein:

the main rack comprises a central shaft mounted for rotation about the central axis;

the power device includes a driving wheel; and the drive means further includes a driven wheel fixedly mounted on the central shaft and engageable with the driving wheel, a sun gear journaled on the central shaft, a lock device operative to preclude rotation of the sun gear about the central axis irrespective of rotation of the central shaft, and a planet gear mounted on each subassembly axis, drivingly engaging the respective rack subassembly, and meshing with the sun gear.

8. A coating apparatus according to claim 7 wherein:

the central axis is a vertical axis; and the main rack assembly and the rack subassemblies carried thereby are positioned above the carriage.

9. A painting apparatus comprising:

a main rack assembly including a central vertical shaft mounted for rotation about a central vertical axis, an upper support structure fixed to an upper end of the shaft, and a lower support structure fixed to the shaft below the upper support structure;

a paint spray apparatus positioned proximate the main rack assembly;

a plurality of rack subassemblies mounted for respective rotation about a plurality of subassembly axes spaced circumferentially about and parallel to the central axis and each including an upper pivot structure journaled in the upper support structure on the respective subassembly axis, a lower pivot structure journaled in the lower support structure on the respective subassembly axis, a part support bar extending vertically between the upper pivot structure and the lower pivot structure, and a plurality of part holder devices mounted on the support bar at vertically spaced locations and operative to releasably mount parts to be painted along the support bar;

a drive wheel mounted on the central shaft for engagement by a drive mechanism to rotate the shaft and thereby the upper support structure, the lower support structure, and the rack subassemblies about the central axis; and a secondary drive mechanism operative in response to rotation of the central shaft about the central axis to rotate the rack subassemblies about their respective axes.

10. A painting apparatus according to claim 9 wherein the secondary drive mechanism comprises a sun gear journaled on the central shaft, a lock device operative to preclude rotation of the sun gear about the central axis irrespective of rotation of the central shaft, and a planet gear mounted on each subassembly axis, drivingly engaging a pivot structure of the respective rack subassembly, and meshing with the sun gear.

11. A painting apparatus according to claim 10 wherein the engaged pivot structure of each subassembly is the lower pivot structure.

12. A painting apparatus according to claim 9 wherein each part support bar is offset with respect to the axis of the respective rack subassembly and is connected at its upper and lower ends by crank arm structures to the upper and lower pivot structures.

13. A painting apparatus comprising:

a track structure defining a path;

a load station, a paint application station, and an unload station positioned at spaced locations along the path;

a paint spray apparatus positioned at the paint application station;

a carriage;

means for moving the carriage along the path between the load station, the paint application station, and the unload station;

means for halting the carriage at the paint application station;

means for initiating the operation of the paint spray apparatus in response to halting of the carriage at the paint application station;

a main rack assembly mounted on the carriage for rotation about a central axis;

a plurality of rack subassemblies carried by the main rack assembly and mounted for respective rotation about a plurality of subassembly axes spaced circumferentially about and parallel to the central axis;

a plurality of part holder devices provided on each rack subassembly at spaced locations along the respective subassembly axis; and drive means, including a power device at the paint application station, operative with the carriage halted at the paint application station, and simultaneous with the operation of the paint spray apparatus, to spin the main rack about the central axis while simultaneously spinning the rack subassemblies about their respective subassembly axes.

14. A painting apparatus according to claim 13 wherein:

the main rack assembly comprises a central vertical shaft mounted in the carriage for rotation about the central axis, an upper support structure proximate an upper end of the shaft, and a lower support structure proximate a lower end of the shaft; and each rack subassembly includes a vertical part support structure journaled at an upper end thereof in the upper support structure, journaled at a lower end thereof in the lower support structure, and mounting said part holder devices intermediate the upper and lower ends thereof.

15. A painting apparatus according to claim 14 wherein the drive means includes primary drive means, including the power device at the paint application station, operative to spin the vertical shaft about the central axis and secondary drive means operative to spin the vertical part support structures about the subassembly axes.

16. A painting apparatus according to claim 15 wherein the secondary drive means are driven by the primary drive means via the spinning of the vertical shaft.

17. A painting apparatus according to claim 16 wherein:

the power device includes a driving wheel; and the primary drive means further includes a driven wheel fixedly mounted on the central shaft and engageable with the driving wheel with the carriage halted at the paint application station.

18. A painting apparatus according to claim 17 wherein the secondary drive means includes a sun gear journaled on the central shaft, a lock device operative to preclude rotation of the sun gear about the central axis irrespective of rotation of the central shaft, and a planet gear mounted on each subassembly axis drivingly engaging the respective vertical part support structure and meshing with the sun gear.

19. A painting apparatus according to claim 18 wherein each part support structure includes an upper pivot structure journaled in the upper support structure on the respective subassembly axis, a lower pivot structure journaled in the lower support structure on the respective subassembly axis, and a part support bar extending vertically between the upper pivot structure and the lower pivot structure and mounting the part holder devices at vertically spaced locations thereon.

20. A painting apparatus according to claim 19 wherein each part support bar is offset with respect to the axis of the respective rack subassembly and is connected at its upper and lower ends by crank arms to the upper and lower pivot structures.

* * * * *